US009854852B2

(12) United States Patent
Yuasa et al.

(10) Patent No.: US 9,854,852 B2
(45) Date of Patent: Jan. 2, 2018

(54) CLOTHING ARTICLE HAVING CUP PARTS

(71) Applicant: Wacoal Corp., Kyoto-shi, Kyoto (JP)

(72) Inventors: Masaru Yuasa, Kyoto (JP); Megumi Tachiri, Kyoto (JP); Masumi Fujii, Kyoto (JP)

(73) Assignee: WACOAL CORP., Kyoto-Shi, Kyoto (JP)

( * ) Notice: Subject to any disclaimer, the term of this patent is extended or adjusted under 35 U.S.C. 154(b) by 113 days.

(21) Appl. No.: 14/779,631

(22) PCT Filed: Mar. 24, 2014

(86) PCT No.: PCT/JP2014/058062
§ 371 (c)(1),
(2) Date: Sep. 24, 2015

(87) PCT Pub. No.: WO2014/157076
PCT Pub. Date: Oct. 2, 2014

(65) Prior Publication Data

US 2016/0044972 A1 Feb. 18, 2016

(30) Foreign Application Priority Data

Mar. 29, 2013 (JP) ..... 2013-073099

(51) Int. Cl.
*A41C 3/12* (2006.01)
*A41C 3/10* (2006.01)
*A41C 3/00* (2006.01)

(52) U.S. Cl.
CPC ..... *A41C 3/12* (2013.01); *A41C 3/0007* (2013.01); *A41C 3/10* (2013.01)

(58) Field of Classification Search
CPC ..... A41C 3/00; A41C 3/0021; A41C 3/10; A41C 3/0007
(Continued)

(56) References Cited

U.S. PATENT DOCUMENTS 2,497,324 A * 2/1950 Schenkman ..... A41C 3/0021 2/338
2,802,213 A * 8/1957 Rosenthal ..... A41C 3/0021 450/60
(Continued)

FOREIGN PATENT DOCUMENTS

CN 101647602 A 2/2010
CN 202154048 U 3/2012
(Continued)

OTHER PUBLICATIONS

Office Action of counterpart Chinese Patent Application No. 201480016927.2 dated Nov. 18, 2016.
(Continued)

*Primary Examiner* — Gloria Hale
(74) *Attorney, Agent, or Firm* — Leydig Voit & Mayer

(57) ABSTRACT

A brassiere according to one embodiment of the present invention has cup parts, a base part, wings, lower edge portions each of which extends along a lower edge of the cup part in a boundary between the cup part and the base part, and side press parts each of which is located in a side lower part of the cup part on the back side of the cup part, has a non-stretchable or poorly-stretchable characteristic, and presses a breast side area; the side press part is superimposed on a side portion of the lower edge portion on the back side of the lower edge portion, is supported by any one of a lower area of a side edge of the cup part, a side area of a lower edge of the cup part, a side edge of the base part, and a side area of a lower edge of the base part, and is substantially not supported except in the supported portion.

3 Claims, 9 Drawing Sheets

(58) Field of Classification Search
USPC ..... 450/60, 61, 59, 31, 41, 53
See application file for complete search history.

(56) References Cited

U.S. PATENT DOCUMENTS

| | | | | | |
|---|---|---|---|---|---|
| 2,896,632 | A * | 7/1959 | Di Tullio | A41C 3/0007 | 450/53 |
| 2,899,961 | A * | 8/1959 | Faron | A41C 3/10 | 450/41 |
| 2,986,143 | A * | 5/1961 | Erteszek | A41C 3/00 | 450/60 |
| 3,128,770 | A * | 4/1964 | Laguzzi | A41C 3/00 | 450/60 |
| 3,166,077 | A * | 1/1965 | Laguzzi | A41C 3/00 | 450/61 |
| 7,452,260 | B2 * | 11/2008 | Redenius | A41C 3/0021 | 450/60 |
| 7,645,179 | B2 * | 1/2010 | Redenius | A41C 3/0021 | 2/67 |
| 8,187,053 | B2 * | 5/2012 | Haworth | A41C 3/0021 | 450/59 |
| 8,187,054 | B2 * | 5/2012 | Redenius | A41C 3/0021 | 450/59 |
| 8,758,081 | B2 * | 6/2014 | Yuasa | A41C 3/0021 | 450/31 |

FOREIGN PATENT DOCUMENTS

| | | | |
|---|---|---|---|
| JP | S46-36177 | U | 12/1971 |
| JP | S62-203209 | U | 12/1987 |
| JP | 07-097701 | A | 4/1995 |
| JP | 10-292208 | A | 11/1998 |
| JP | 2000-017505 | A | 1/2000 |
| JP | 2000-064105 | A | 2/2000 |
| JP | 2006-225819 | A | 8/2006 |
| JP | 2008-163490 | A | 7/2008 |
| JP | 2009-052174 | A | 3/2009 |
| JP | 2012-077387 | A | 4/2012 |

OTHER PUBLICATIONS

International Bureau, International Search Report in international application No. PCT/JP2014/058062, dated Jun. 17, 2014.

* cited by examiner

CLOTHING ARTICLE HAVING CUP PARTS

CROSS-REFERENCE TO RELATED APPLICATIONS

The application is the U.S. national Stage of International Application Number PCT/JP2014/058062, filed on Mar. 24, 2014, which claims the benefit of Japanese Patent Application Number P2013-073099, filed on Mar. 29, 2013, which are each incorporated by reference.

TECHNICAL FIELD

The present invention relates to a closing article having cup parts for covering breasts.

BACKGROUND ART

Patent Literatures 1 to 4 disclose brassieres as closing articles having cup parts for covering the breasts. These brassieres are provided with members for enhancing shaping capability of breast side areas.

Specifically, the brassiere disclosed in Patent Literature 1 is provided with side reinforcement members 7 of a tape shape each of which extends on a side edge of the cup part running from an upper end to a side terminal of a lower-edge curved part of the cup part and on a lower extension thereof. The brassiere disclosed in Patent Literature 2 is provided with, stretchable support fabrics 5 on the back side of side areas of the cup parts and also provided with non-stretchable side cup top fabrics 12 on the front side of the side areas of the cup parts. The brassiere disclosed in Patent Literature 3 is provided with stretchable cup side fabrics 6. These side reinforcement members 7, support fabrics 5, side cup top fabrics 12, and cup side fabrics 6 are coupled to strap parts and act to press the breasts from their side, by making use of upward pull force by the strap parts, in addition to lateral pull force by wings.

On the other hand, the brassiere disclosed in Patent Literature 4 is provided with bones 14 inclined downward from side parts of the verge's line toward the back and is also provided with elastomer resin 19 on the side areas of the cup parts.

CITATION LIST

Patent Literatures

Patent Literature 1: Japanese Patent Application Laid-open Publication No. 2000-64105

Patent Literature 2: Japanese Patent Application Laid-open Publication No. H07-97701

Patent Literature 3: Japanese Utility Model Laid-open Publication No. S62-203209

Patent Literature 4: Japanese Patent Application Laid-open Publication No. H10-292208

SUMMARY OF INVENTION

Technical Problem

It is an, object of the present invention to provide a clothing article with cup parts capable of enhancing the shaping capability of the breast side areas, in the same manner as above.

Solution to Problem

The Inventors made an attempt to enhance the shaping capability of the breast side areas by only the lateral pull force by the wings, without making use of the upward pull force by the strap parts. In this attempt, the Inventors focused attention on the fact that the lateral pull force by the wings generates press force toward the wearer in lower edge portions. Then the Inventors came to discover that this press three toward the wearer by the lower edge portions could be utilized to press the breast side areas by a surface, so as to shape the breast side areas in a neat silhouette.

A clothing article having cup parts according to the present invention is a clothing article having; cup parts for covering breasts; a base part for supporting lower edges of the cup parts; wings for supporting the base part and the cup parts; and lower edge portions extending along the lower edges of the cup parts in boundaries between the cup parts and the base part, the clothing article comprising: side press parts each of which is located in a side lower part of the cup part on the back side of the cup part, has a non-stretchable or poorly-stretchable characteristic, and presses a breast side area, wherein the side press part is superimposed on a side portion of the lower edge portion on the back side of the lower edge portion, is supported by any one of a lower area of a side edge of the cup part, a side area of a lower edge of the cup part, a side edge of the base part, and a side area of a lower edge of the base part, and is substantially not supported except in the supported portion.

The term "substantially not supported" herein shall embrace, for example, not only—not sewn—but also—easily sewn so as to be displaceable relative to the cup part and the lower edge portion—.

In this clothing article having the cup parts, since the side press part is superimposed on the side portion of the lower edge portion on the back side of the lower edge portion, the side press part can press the breast side area by a surface, by making use of the press force toward the wearer by the lower edge portion, i.e., by making use of force by which the lower edge portion presses the side press part toward the wearer. As a result, the breast side area can be shaped in a neat silhouette, so that the shaping capability of the breast side area can be enhanced.

In this clothing article having the cup parts, the side press part is supported by any one of the side edge of the cup part, the side area of the lower edge of the cup part, the side edge of the base part, and the side area of the lower edge of the base part and is substantially not supported except in the supported portion; for this reason, it is feasible to prevent the shaping capability of the breast side area from being degraded with wearer's motion.

The foregoing lower edge portion may be fitted with a cup wire. This configuration allows the side press part to further press the breast side area by a surface, by also making use of press force toward the wearer by a side end of the cup wire (i.e., force by which the side end of the cup wire presses the side press part toward the wearer). As a result, the breast side area can be shaped in a neater silhouette, so that the shaping capability of the breast side area can be further enhanced.

There are women feeling pain due to contact with the end of the cup wire. In this regard, the above configuration allows the side press part to disperse the press force toward the wearer by the end of the cup wire over a surface; for this reason, it is feasible to suppress the pain due to the contact with the end of the cup wire.

The clothing article may further comprise: smoothing parts each of which is located as spreading from the side edge of the cup part and the side edge of the base part to the wing and to a strap part, having a stretchable characteristic, and functioning to smooth a side upper part with respect to the side edge of the cup part. In this configuration, the smoothing part functions to smooth the side upper part with respect to the side edge of the cup part, so that it can prevent a step from being made at a boundary of the side edge of the cup part.

It should be noted that the configuration with the smoothing part provided between the side edge of the cup part and the strap part has been realized without need for making use of the upward pull force by the strap part, as described above.

Advantageous Effects of Invention

The present invention can enhance the shaping capability of the breast side areas.

DESCRIPTION OF EMBODIMENTS

Figure 1:
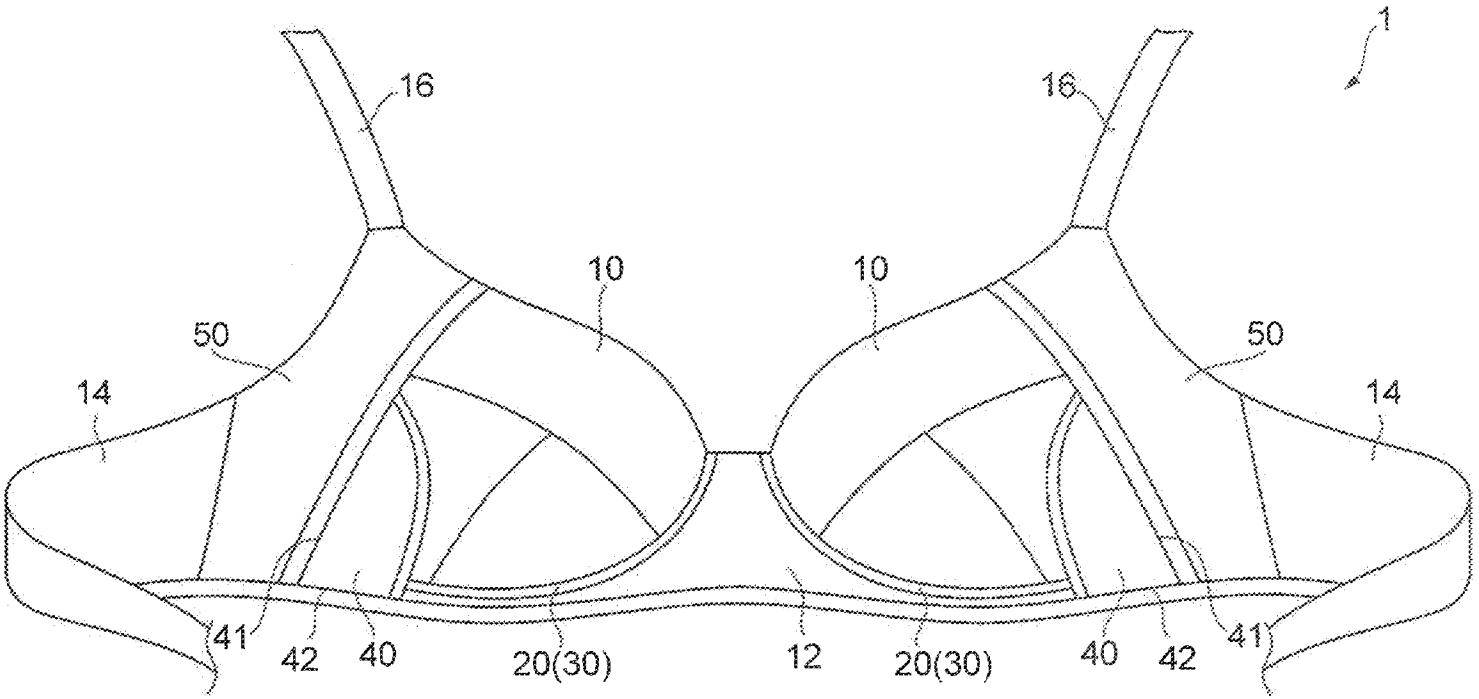
FIG. 1 is a perspective view showing a brassiere according to the first embodiment of the present invention from its back side (skin side).

The preferred embodiments of the closing article having the cup parts according to the present invention will be described below in detail with reference to the drawings. In the drawings identical or equivalent portions will be denoted by the same reference signs.

First Embodiment

FIG. 1 is a perspective view showing the brassiere according to the first embodiment of the present invention from its back side (skin side). The brassiere 1 of the first embodiment is provided with cup parts 10, a base part 12, wings 14, strap parts 16, lower edge portions 20, cup wires 30, side press parts 40, and smoothing parts 50. Since the brassiere 1 is approximately symmetric with respect to the center line, it will be explained below about only one of the right and left halves.

The cup part 10 is a part for covering the breast and is three-dimensionally formed, for example, by joining three pieces of cloth so as to have approximately T-shaped seams (T-shaped three-piece joint cup). The cup part 10 is supported on the base part 12. The base part 12 is made of a non-stretchable fabric and is sewn to a lower edge of the cup part 10. A side edge of the cup part 10 and a side edge of the base part 12 are coupled through the smoothing part 50 to the wing 14. The wing 14 is made of a stretchable fabric and is a part for being coupled to the other wing on the back, thereby supporting the base part 12 and the cup part 10. An upper area of the side edge of the cup part 10 is coupled through the smoothing part 50 to the strap part 16. The strap part 16 is made of a stretchable tape material and is a part for being coupled to the wing 14 via the shoulder, thereby supporting the cup part 10.

A tape member is sewn along the lower edge of the cup part 10 to the back side (skin side) in a boundary between the cup part 10 and the base part 12, thereby forming the lower edge portion 20. The cup wire 30 is set inside this lower edge portion 20. Furthermore, a stretchable tape member is sewn to the back side of a lower edge of the base part 12, the back side of a lower edge of the smoothing part 50, and the back side of a lower edge of the wing 14. In addition, a stretchable tape member is also sewn to the back side of a region from the side edge of the cup part 10 to the side edge of the base part 12. The side press part 40 is provided on the back side of the cup part 10. The side press part 40 and the smoothing part 50 will be described below in detail.

The side press part 40 is a part for pressing the breast side area, and is arranged on the back side of the cup part 10 and the base part 12, as spreading from a side lower part of the cup part 10 to a side part of the base part 12. Furthermore, the side press part 40 is superimposed on the back side of side portions of the lower edge portion 20 and the cup wire 30.

More specifically, a side edge 41 of the side press part 40 is sewn to a region from the lower area of the side edge of the cup part 10 to the side edge of the base part 12 and a lower edge 42 of the side press part 40 is sewn to the lower edge of the base part 12. Namely, the side edge 41 of the side press part 40 is supported by the lower area of the side edge of the cup part 10 and the side edge of the base part 12 and the lower edge 42 of the side press part 40 is supported by the lower edge of the base part 12.

The portion other than the side edge 41 and the lower edge 42 of the side press part 40 is substantially not supported. Namely, the portion other than the side edge 41 and the lower edge 42 of the side press part 40 may not be sewn to the cup part 10 and the base part 12 or may be easily sewn so as to be displaceable relative to the cup part 10 and, the base part 12. The edge other than the side edge 41 and lower edge 42 of the side press part 40 may be processed by an end treatment.

A non-stretchable or poorly-stretchable member is used as the side press part 40. The side press part 40 may have a cushioning characteristic.

Next, the smoothing part 50 is a part that functions to smooth the side upper part with respect to the side edge of the cup part 10 and, as described above, it is provided from the cup part 10 and base part 12, to the wing 14 and to the strap part 16.

Specifically, a front edge of the smoothing part 50 is sewn to a region from the side edge of the cup part 10 to the side edge of the base part 12 and a lower area of a side edge of the smoothing part 50 is sewn to the wing 14. An upper edge of the smoothing part 50 extends obliquely upward along an extension line of an upper edge of the cup part 10 and the strap part 16 is sewn to a side area of the upper edge of the smoothing part 50. An upper area of the side edge from a joint to the strap part 16 to a joint to the wing 14 in the smoothing part 50 extends in a curve along the body below the wearer's armpit.

A stretchable member is used as the smoothing part 50. The upper edge and the upper area of the side edge of the smoothing part 50 may be configured as seamless edges necessitating no end treatment. An upper edge of the wing 14 may also be configured as a seamless edge.

Figure 2:
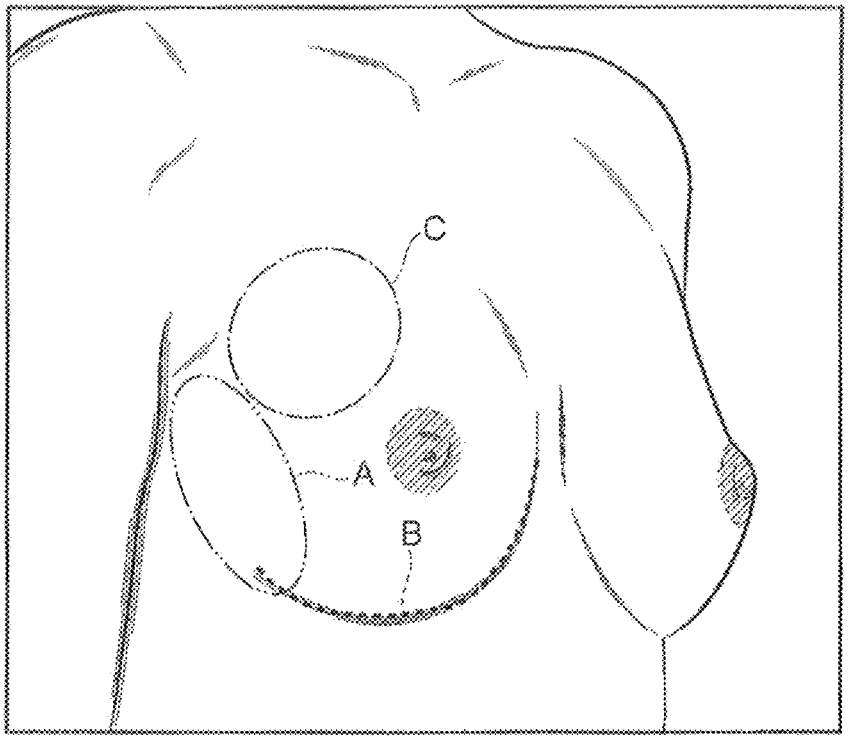
FIG. 2 is a drawing showing a breast side area.

There are needs for shaping the breast side area in a neat silhouette. For example, as shown in FIG. 2, middle-aged and elderly women come to have the breast sagging with flesh flowing to the breast side area A, whereby the boundary between the breast side area and the trunk, i.e., the side area of the verge's line B becomes unclear. In addition, a breast upper area C becomes sunk. The Inventors have discovered in this regard that when the breast side area A was pressed by a surface, the breast side area could be shaped in a neat silhouette and the flesh in the breast side area A could be efficiently moved to the breast upper area C.

Even among young girls, there are some girls annoyed by the flesh in the breast side area A and there are also needs for shaping the breast side area in a neat silhouette. Namely, the features of the present invention can be applicable to all women from the young to old generations.

The Inventors made the attempt to enhance the shaping capability of the breast side area by only the lateral pull force by the wing, without making use of the upward pull force by the strap part. In this attempt, the Inventors focused attention on the fact that the lateral pull force by the wing generates the press force toward the wearer in the lower edge portion. Then the Inventors came to discover that this press force toward the wearer by the lower edge portion could be utilized to press the breast side area by a surface, so as to shape the breast side area in a neat silhouette.

Concealing these respects, since the brassiere 1 of the first embodiment has the side press part 40 superimposed on the side portion of the lower edge portion 20 on the back side of the lower edge portion 20, the side press part 40 can press the breast side area by a surface, by making use of the press force toward the wearer by the lower edge portion 20, i.e., by making use of the force by which the lower edge portion 20 presses the side press part 40 toward the wearer. Furthermore, the side press part 40 can press the breast side area by a surface, by also making use of the press force toward the wearer by the side end of the cup wire 30 (i.e., the force by which the side end of the cup wire 30 presses the side press part 40 toward the wearer). As a result, the breast side area can be shaped in a neat silhouette, so that the shaping capability of the breast side area can be enhanced.

In the brassiere 1 of the first embodiment, the side press part 40 is supported by the side edge of the cup part 10 and the sidle edge of the base part 12 and substantially not supported except in the supported portion; for this reason, it is feasible to prevent the shaping capability of the breast side area from being degraded with wearer's motion.

In the brassiere 1 of the first embodiment, the press force toward the wearer by the end of the cup wire 30 can be dispersed over a surface by the side press part 40, and therefore the wearer can be prevented from feeling pain due to contact with the end of the cup wire 30.

In the brassiere 1 of the first embodiment, the smoothing part 50 functions to smooth the side upper part with respect to the side edge of the cup part 10, so that it can prevent a step from being made at a boundary of the side edge of the cup part 10. It should be noted that the configuration with the smoothing part 50 provided between the upper area of the side edge of the cup part 10 and the strap part 16 is one that has been realized without need for making use of the upward pull force by the strap part 16, as described above.

[Modification Examples of First Embodiment]

Figure 3:
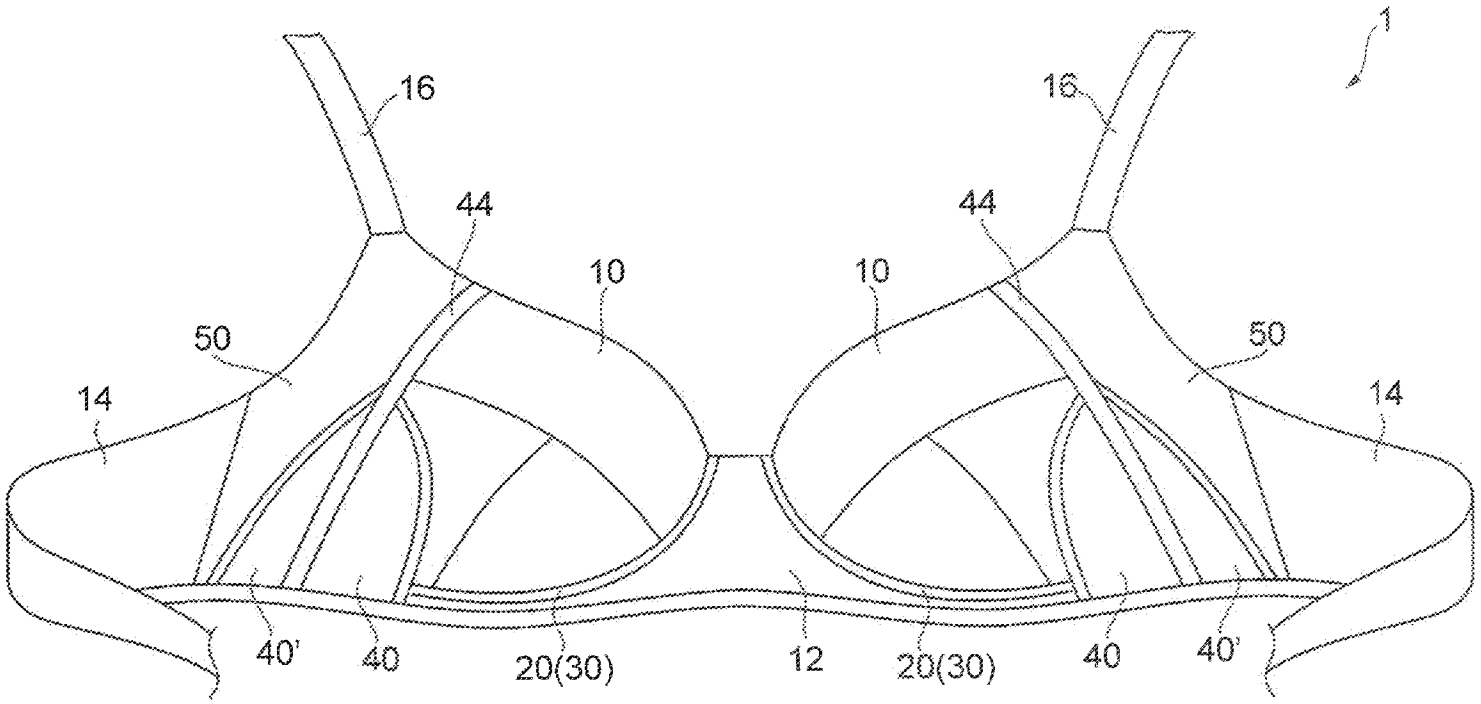
FIG. 3 is a perspective view showing a brassiere according to a modification example of the first embodiment from its back side.
Figure 4:
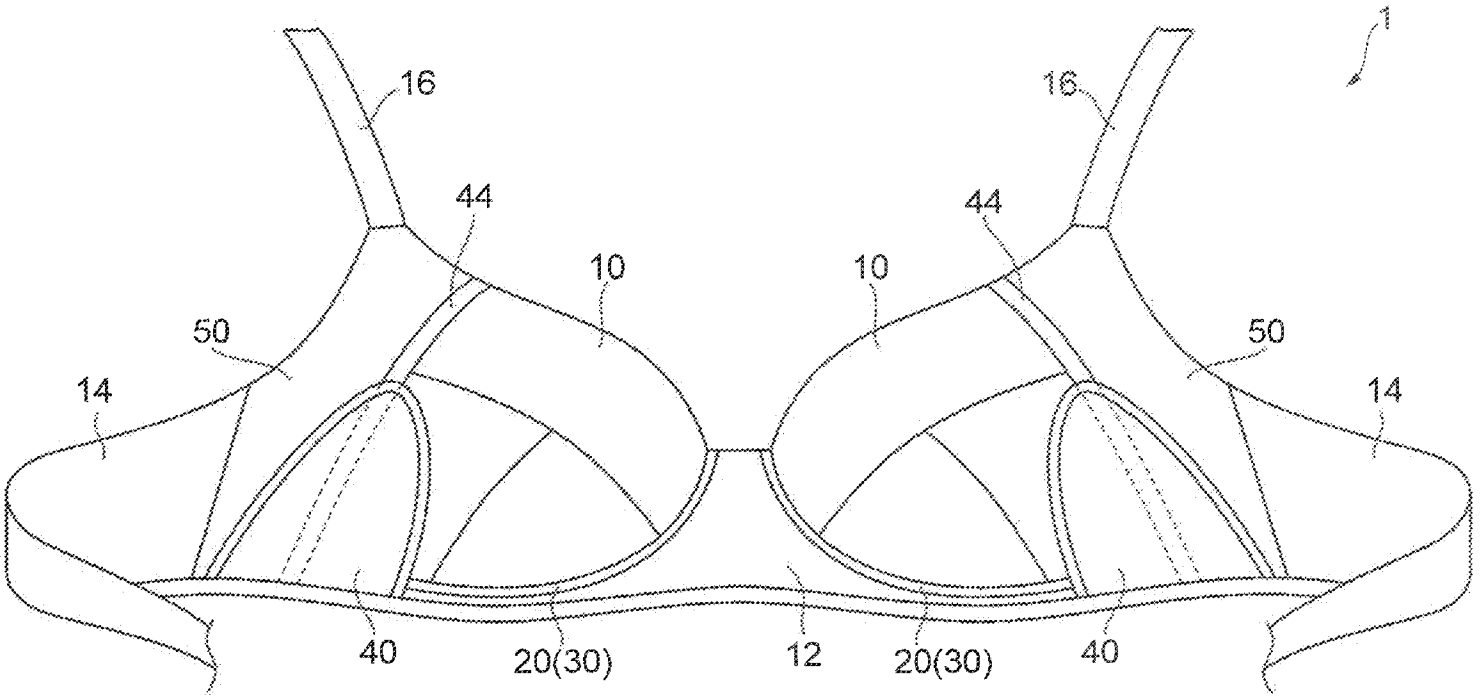
FIG. 4 is a perspective view showing a brassiere according to a modification example of the first embodiment from its back side.
Figure 5:
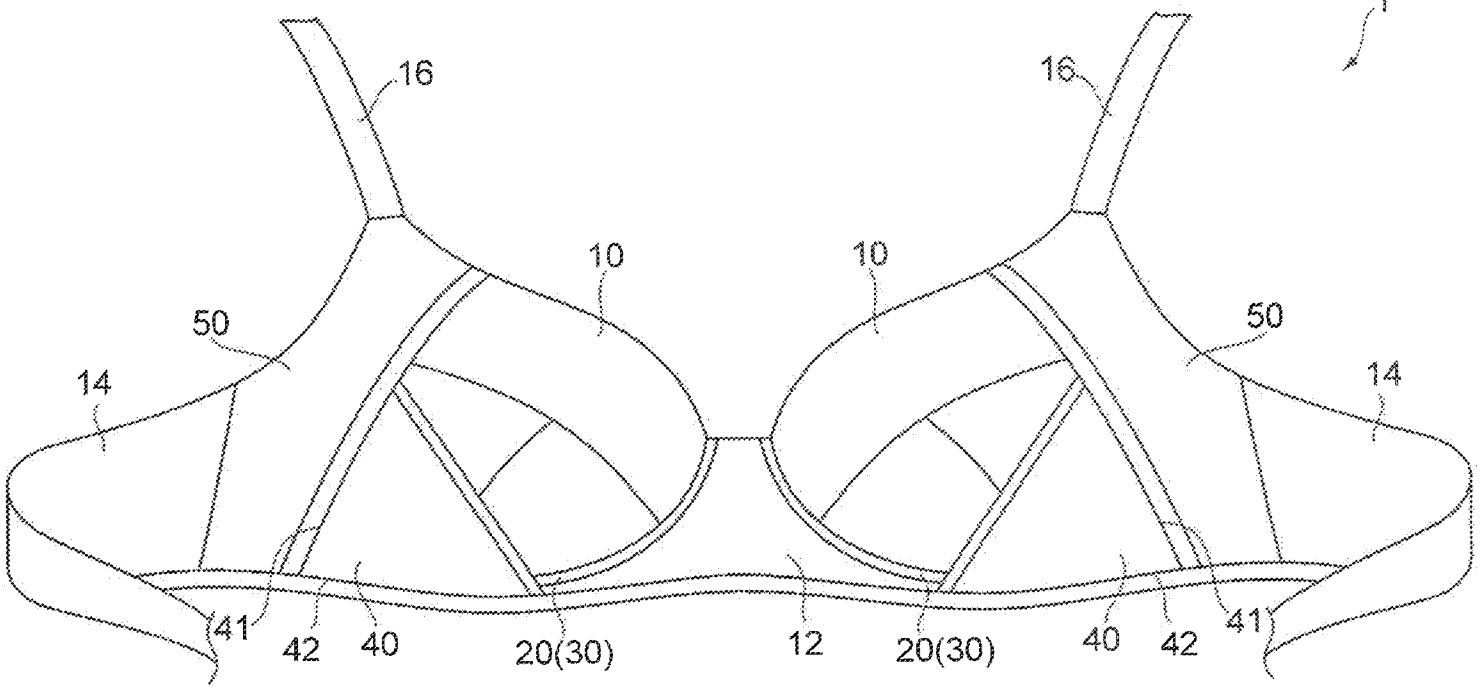
FIG. 5 is a perspective view showing a brassiere according to a modification example of the first embodiment from its back side.

FIGS. 3 to 5 are drawings showing the brassieres according to modification examples of the first embodiment from the back side (skin side). As shown in FIG. 3, a side press part 40' may be further provided on the back side of a side region farther than the lower area of the side edge of the cup part 10 and the side edge of the base part 12. A member similar to the side press part 40 is used as the side press part 40'.

More specifically, a front edge of the side press part 40' is sewn to a region from the lower area of the side edge of the cup part 10 to the side edge of the base part 12 and a lower edge of the side press part 40' is sewn to the lower edge of the smoothing part 50. Namely, the front edge of the side press part 40' is supported by the lower area of the side edge of the cup part 10 and the side edge of the base part 12 and the lower edge of the side press part 40' is supported by the lower edge of the smoothing part 50.

The portion other than the front edge and lower edge of the side press part 40' is substantially not supported. Namely, the portion other than the front edge and lower edge of the side press part 40' may not be sewn to the cup part 10 and the smoothing, part 50 or may be easily sewn so as to be displaceable relative to the cup part 10 and the smoothing part 50. The edge other than the front edge and lower edge of the side press part 40' may be processed by the end treatment.

FIG. 3 showed an example in which, the side press part 40 and side press part 40' were arranged on the front side of a side cloth bias tape 44 and were sewn together with the side cloth bias tape 44, but the side press part 40 and side press part 40' may be arranged on the back side (skin side) of the side cloth bias tape 44 and sewn together with the side cloth bias tape 44.

As shown in FIG. 4, the side press part 40 and side press part 40' shown in FIG. 3 may be integrally formed so as to constitute the side press part 40 and this side press part 40 may be arranged on the back side (skin side) of the side cloth bias tape 44.

More specifically, the lower edge of the side press part 40 is sewn to the side area of the lower edge of the base part 12 and to the lower edge of the smoothing part 50. Namely, the lower edge of the side press part 40 is supported by the side area of the lower edge of the base part 12 and the lower edge of the smoothing part 50.

The portion other than the lower edge of the side press part 40 is substantially not supported. Namely, the portion other than the lower edge of the side press part 40 may not be sewn to the cup part 10, base part 12, smoothing part 50, and side cloth bias tape 44, or may be easily sewn so as to be displaceable relative to the cup part 10, base part 12, smoothing part 50, and side cloth bias tape 44. The edges other than the lower edge of the side press part 40 may be processed by the end treatment.

FIG. 4 showed an example in which the side press part 40 was arranged on the back side of the side cloth bias tape 44, but the side press part 40 may be arranged on the front side of the side cloth bias tape 44. For example, the side press part. 40 may be arranged on the front side of the side cloth bias tape 44 and on the back side of the cup part 10, base part 12, and smoothing part 50. In this case, the side press part 40 may be sewn together with the side cloth bias tape 44.

As shown in FIG. 5, a front center area of the lower edge of the side press part 40 may be located near the lowest point of the verge's line. Namely, the side pressing part 40 may be superimposed on the lower edge portion 20 and the cup wire 30, as spreading from near the lowest point to the side area of the verge's line, i.e., spreading from near the lowest point of the lower edge portion 20 to the side portion thereof.

Second Embodiment

Figure 6:
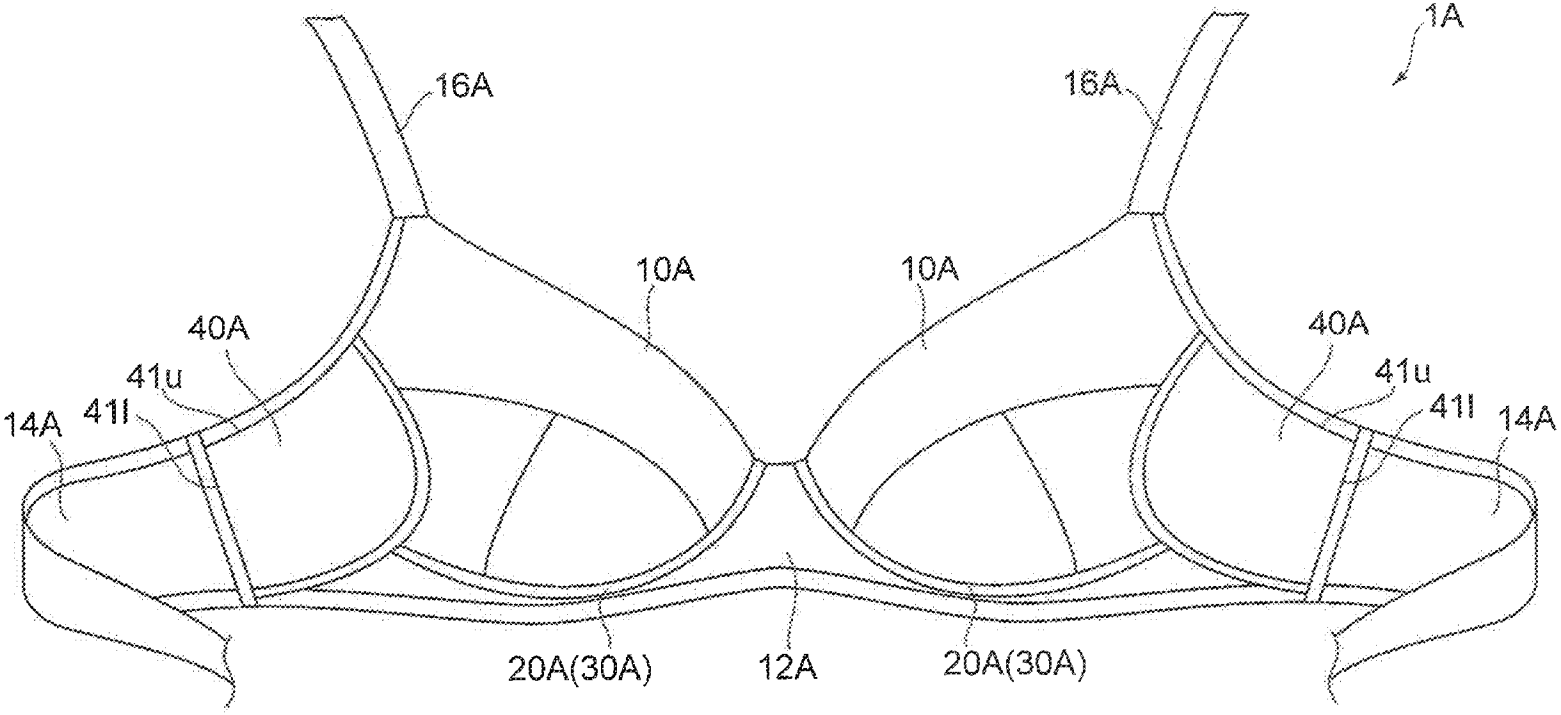
FIG. 6 is a perspective view showing a brassiere according to the second embodiment of the present invention from its back side.

FIG. 6 is a perspective view showing the brassiere according to the second embodiment of the present invention from the back side (skin side). The brassiere 1A of the second embodiment is different mainly in a configuration without the smoothing parts 50 from the brassiere 1 of the first embodiment. Specifically, the brassiere 1A of the second embodiment is provided with cup parts 10A, a base part 12A, wings 14A, strap parts 16A, lower edge portions 20A, cup wires 30A, and side press parts 40A. Since the brassiere 1A is approximately symmetric with respect to the center line, it will be explained below about only one of the right and left halves.

The cup part 10A is a part for covering the breast and is three-dimensionally formed, for example, by joining three pieces of cloth so as to have approximately T-shaped seams (T-shaped three-piece joint cup), as the cup part 10 is. The cup part 10A is supported on the base part 12A. The base part 12A is made of a non-stretchable fabric and sewn to a lower edge of the cup part 10A as the base part 12 is. The wing 14A is sewn to a side area of the base part 12A. The wing 14A is made of a stretchable fabric and is a part for being coupled to the other wing on the back, thereby supporting the base part 12A and the cup part 10A, as the wing 14 is. The strap part 16A is sewn to a side area of an upper edge of the cup part 10A. The strap part 16A is made of a stretchable tape material and is a part for being coupled to the wing 14A via the shoulder, thereby supporting the cup part 10A, as the strap part 16 is.

A tape member is sewn along the lower edge of the cup part 10A to the back side (skin side) in a boundary between the cup part 10A and the base part 12A, thereby forming the lower edge portion 20A. The cup wire 30A is set inside this lower edge portion 20A. Furthermore, a stretchable tape member is sewn to the back side of a lower edge of the base part 12A, the back side of a lower edge of the wing 14A, and the back side of a side edge of the base part 12A being a joint between the base part 12A and the wing 14A. In addition, a stretchable tape member is also sewn to the back side of a region from the side edge of the cup part 10A via the upper edge of the base part 12A to the upper edge of the wing 14A. The side press part 40A is provided on the back side of the cup part 10A.

Next, the side press part 40A will be described in detail. The side press part 40A is a part for pressing the breast side area, and is arranged on the back side of the cup part 10A and the base part 12A, as spreading from a side lower part of the cup part 10A to the side edge of the base part 12A. Furthermore, the side press part 40A is superimposed on the back side of side portions of the lower edge portion 20A and the cup wire 30A.

More specifically, an upper area 41*u* of a side edge of the side press part 40A is sewn to a region from the lower area of the side edge of the cup part 10A to the upper edge of the base part 12A and a lower area 41*l* of the side edge of the side press part 40A is sewn to the side edge of the base part 12A. Namely, the upper area 41*u* of the side edge of the side press part 40A is supported by the lower area of the side edge of the cup part 10A and the upper edge of the base part 12A and the lower area 41*l* of the side edge of the side press part 40A is supported by the side edge of the base part 12A.

The portion other than the upper area 41*u* of the side edge and the lower area 41*l* of the side edge of the side press part 40A is substantially not supported. Namely, the portion other than the upper area 41*u* of the side edge and the lower area 41*l* of the side edge of the side press part 40A may not be sewn to the cup part 10A and the base part 12A or may be easily sewn so as to be displaceable relative to the cup part 10A and the base part 12A. The edge other than the upper area 41*u* of the side edge and the lower area 41*l* of the side edge of the side press part 40A may be processed by the end treatment.

A non-stretchable or poorly-stretchable member is used as the side press part 40A, similar to the side press part 40. The side press part 40A may have a cushioning characteristic.

Since this brassiere 1A of the second embodiment also has the side press part 40A superimposed on the side portion of the lower edge portion 20A on the back side of the lower edge portion 20A, the side press part 40A can press the breast side area by a surface, by making use of the press force toward the wearer by the lower edge portion 20A. Furthermore, the side press part 40A can press the breast side area by a surface, by also making use of the press force toward the wearer by the side end of the cup wire 30A. As a result, the breast side area can be shaped in a neat silhouette, so that the shaping capability of the breast side area can be enhanced.

In the brassiere 1A of the second embodiment, the side press part 40A is also supported by the side edge of the cup part 10A, the upper edge of the base part 12A, and the side edge of the base part 12A and substantially not supported except in the supported portion; for this reason, it is feasible to prevent the shaping capability of the breast side area from being degraded with wearer's motion.

In the brassiere 1A of the second embodiment, the press force toward the wearer by the end of the cup wire 30A can also be dispersed over a surface by the side press part 40A, and therefore the wearer can be prevented from feeling pain due to contact with the end of the cup wire 30A.

[Modification Examples of Second Embodiment]

Figure 7:
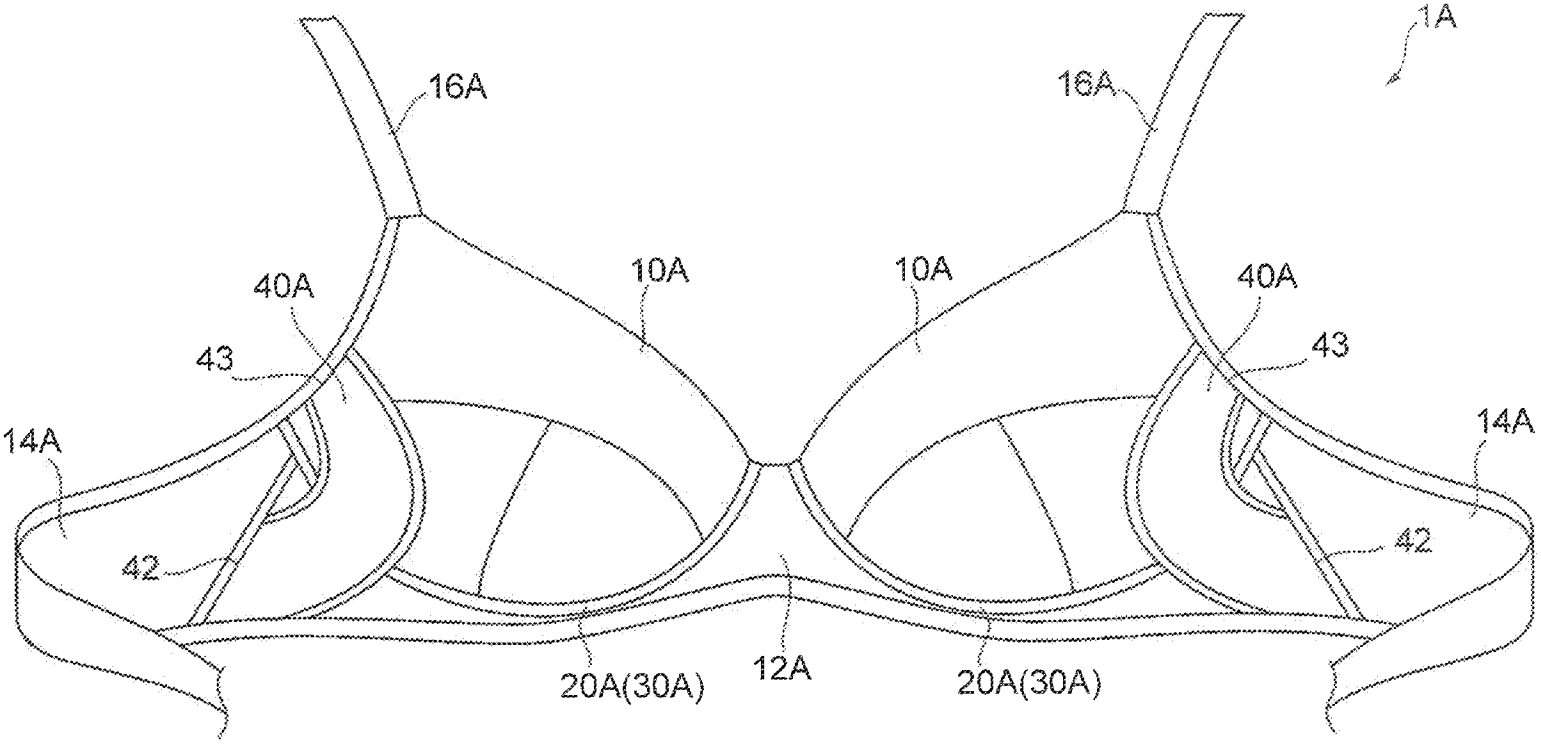
FIG. 7 is a perspective view showing a brassiere according to a modification example of the second embodiment from its back side.
Figure 8:
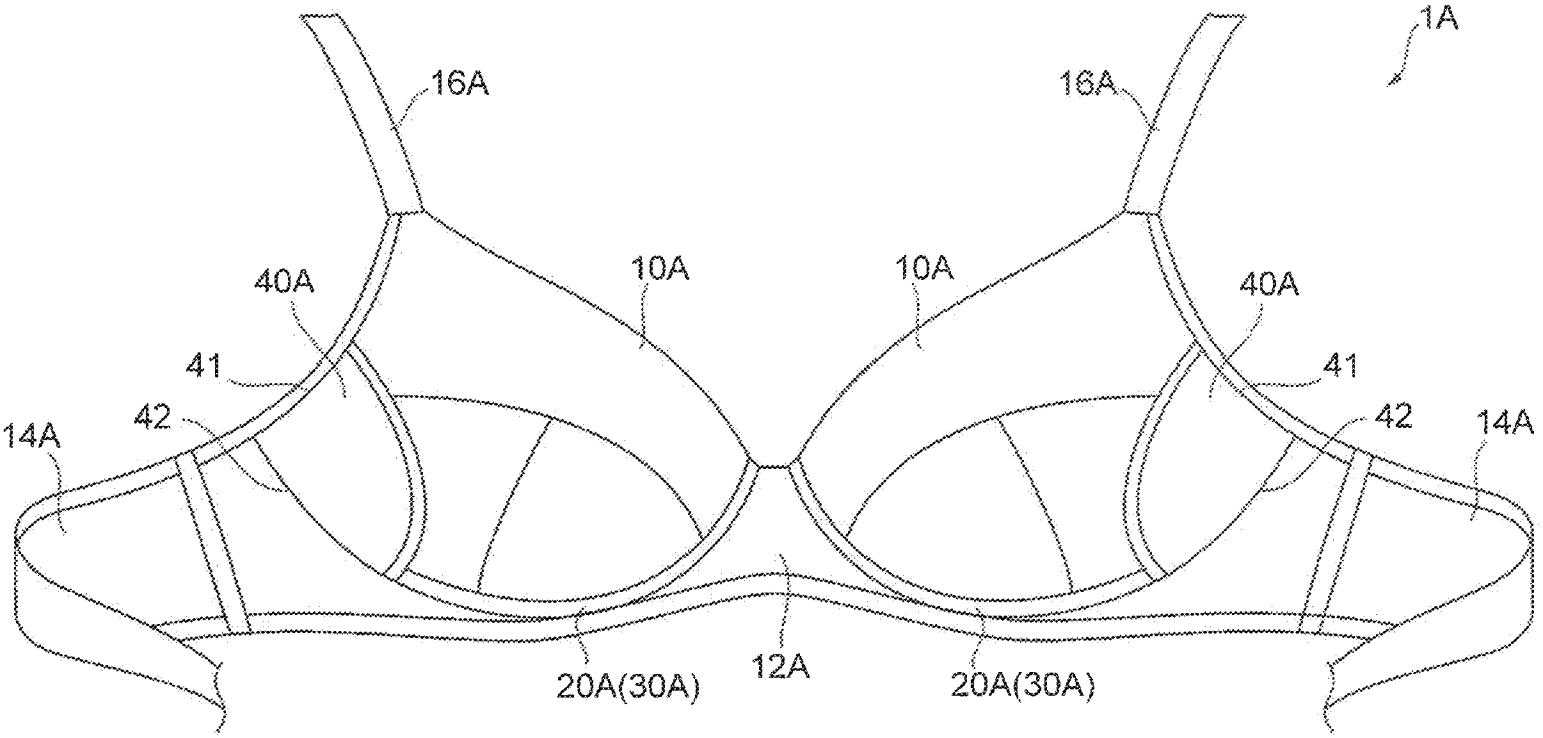
FIG. 8 is a perspective view showing a brassiere according to a modification example of the second embodiment from its back side.
Figure 9:
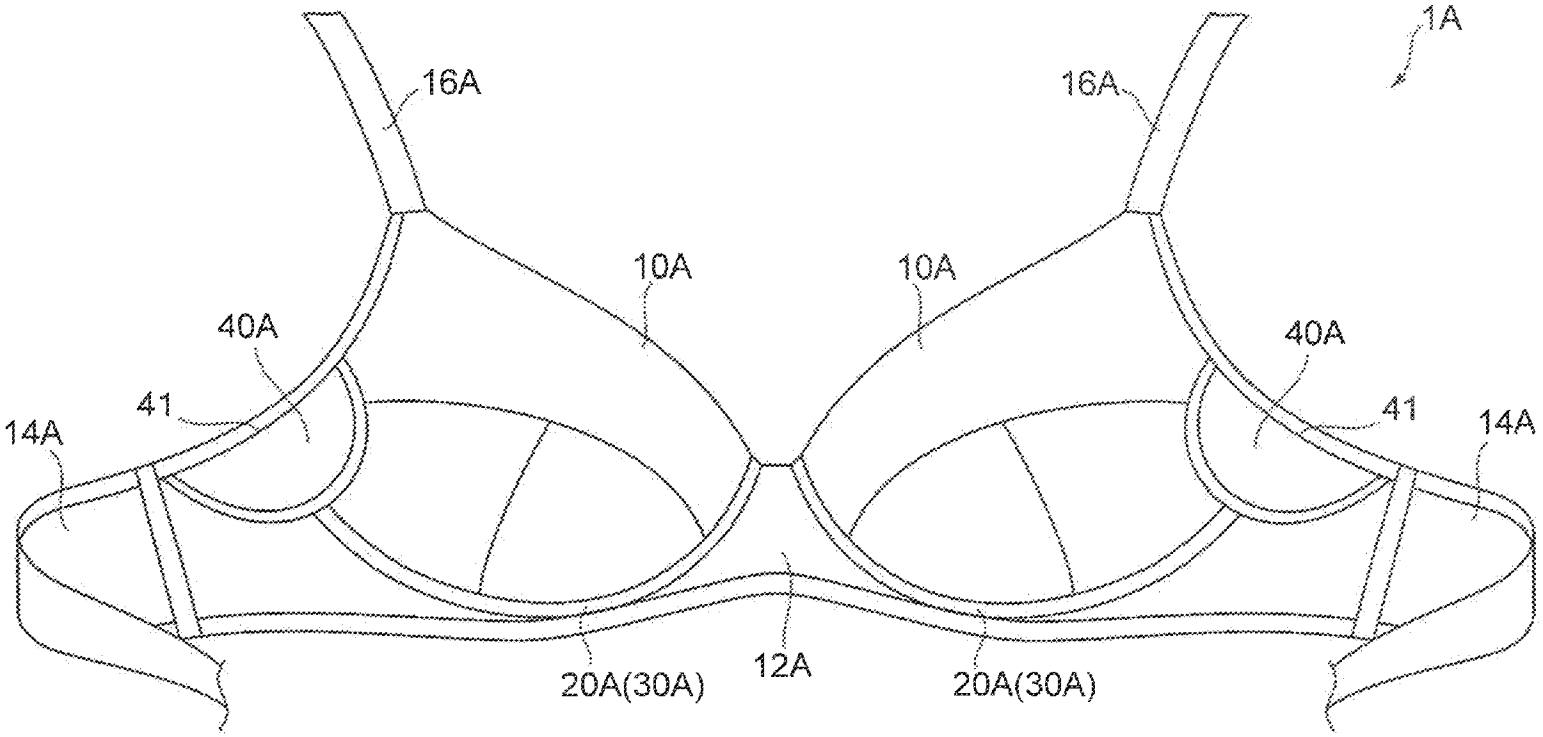
FIG. 9 is a perspective view showing a brassiere according to a modification example of the second embodiment from its back side.

FIGS. 7 to 9 are drawings showing the brassieres according to modification examples of the second embodiment from the back side (skin side). In a configuration different in position of the side edge of the base part 12A being a joint between the base part 12A and the wing 14A, as shown in FIG. 7, the side press part 40A may be arranged across the back side of the side portions of the lower edge portion 20A and the cup wire 30A. In this configuration, the side press part 40A is also arranged on the back side of the cup part 10A and the base part 12A, as spreading from the side lower part of the cup part 10A to the side edge of the base part 12A, and the side press part 40A is superimposed on the back side of the side portions of the lower edge portion 20A and cup wire 30A.

More specifically, an upper edge 43 of the side press part 40A is sewn to the lower area of the side edge of the cup part 10A and a lower edge 42 of the side press part 40A is sewn to the side edge and lower edge of the base part 12A. Namely, the upper edge 43 of the side press part 40A is supported by the lower area of the side edge of the cup part 10A and the lower edge 42 of the side press part 40A is supported by the side edge and lower edge of the base part 12A.

The portion other than the upper edge 43 and lower edge 42 of the side press part 40A is substantially not supported. Namely, the portion other than the upper edge 43 and lower edge 42 of the side press part 40A may not be sewn to the cup part 10A and the base part 12A, or may be easily sewn so as to be displaceable relative to the cup part 10A and the base part 12A. The edges other than the upper edge 43 and lower edge 42 of the side press part 40A may be processed by the end treatment.

As shown in FIG. 8, the side press part 40A may have a configuration in which it is supported by the lower area of the side edge and the side area of the lower edge of the cup part 10A. In this configuration, the side press part 40A is also arranged on the back side of the side lower part of the cup part 10A and superimposed on the back side of the side portions of the lower edge portion 20A and cup wire 30A.

More specifically, the side edge 41 of the side press part 40A is sewn to the lower area of the side edge of the cup part 10A and the lower edge 42 of the side press part 40A is sewn to the side area of the lower edge of the cup part 10A. Namely, the side edge 41 and the lower edge 42 of the side press part 40A are supported by the lower area of the side edge and by the side area of the lower edge, respectively, of the cup part 10A.

The portion other than the side edge 41 and the lower edge 42 of the side press part 40A is substantially not supported. Namely, the portion other than the side edge 41 and the lower edge 42 of the side press part 40A may not be sewn to the cup part 10A or may be easily sewn so as to be displaceable relative to the cup part 10A. Furthermore, the edge other than the side edge 41 and the lower edge 42 of the side press part 40A may be processed by the end treatment.

FIG. 8 showed an example in which the side press part 40A was arranged on the back side of the lower edge portion 20A and sewn together with the lower edge portion 20A, but the side press part 40A may be arranged on the front side of the lower edge portion 20A and sewn together with the lower edge portion 20A.

As shown in FIG. 9, the side press part 40A may have a configuration in which it is supported by only the lower area of the side edge of the cup part 10A and the upper edge of the base part 12A. In this configuration, the side press part 40A is also arranged on the back side of the cup part 10A and the base part. 12A, as spreading from the side lower part of the cup part 10A to the side edge of the base part 12A, and superimposed on the back side of the side portions of the lower edge portion 20A and cup wire 30A.

More specifically, the side edge 41 of the side press part 40A is sewn to a region from the lower area of the side edge of the cup part 10A to the upper edge of the base part 12A and is supported by the lower area of the side edge of the cup part 10A and the upper edge of the base part 12A.

The portion other than the side edge 41 of the side press part 40A is substantially not supported. Namely, the portion other than the side edge 41 of the side press part 40A may not be sewn to the cup part 10A and the base part 12A, or may be easily sewn so as to be displaceable relative to the cup part 10A and the base part 12A. Furthermore, the edge other than the side edge 41 of the side press part 40A may be processed by the end treatment.

The present invention can be modified in many ways without having to be limited to the above-described embodiments of the invention. For example, the embodiments of the invention showed the brassieres with the cup wires 30, 30A by way of illustration, but the features of the present invention can also be applicable to the brassieres of the non-wire type with no cup wires. For example, in the case of the brassieres of the non-wire type, the press force toward the wearer is also generated in the lower edge portion by the lateral pull force by the wing and therefore the side press part can press the breast side area by a surface, by making use of this press three toward the wearer by the lower edge portion.

In the second embodiment, the strap part 16A was sewn to the side area of the upper edge of the cup part 10A, but the strap part 16A may be detachably engaged with the side area of the upper edge of the cup part 10A through an engagement member such as a Z hook & eye clasp.

The embodiments showed the brassieres of a type in which the rear ends of the wings 14, 14A were joined together through a hook or the like, by way of illustration, but the features of the embodiments can also be applicable to the brassieres of a front hook type in which the base part 12, 12A is cut into right and left pieces at the front center and the right and left pieces are joined together through a hook or the like.

The features of the embodiments can also be applicable to brassieres of all types including fill-cup brassieres, ¾ cup brassieres, and half-cup brassieres.

The features of the embodiments can also be applicable to all clothing articles as long as they have cup parts, e.g., bra-slips, bra-camisoles, body suits, teddies with cups, and swimming suits, besides the brassieres.

INDUSTRIAL APPLICABILITY

The present invention is applicable to usage as clothing articles with cup parts capable of enhancing the shaping capability of the breast side areas.

REFERENCE SIGNS LIST

1, 1A brassiere; 10, 10A cup part; 12, 12A base part; 14, 14A wing; 16, 16A strap part; 20, 20A lower edge portion; 30, 30A cup wire; 40, 40A side press part; 41 side edge of side press part; 41*l* lower area of side edge of side press part; 41*u* upper area of side edge of side press part; 42 lower edge of side press part; 43 upper edge of side press part; 44 side cloth bias tape; 50 smoothing part.

The invention claimed is:

1. A clothing article comprising:

cup parts for covering breasts, each cup part having a cup side edge, and a cup side lower part with a cup lower edge, and a cup side upper part;

a base part for supporting the cup lower edges, the base part having base part side edges and base part lower edges;

wings for supporting the base part and the cup parts; and lower edge portions extending from the cup side edges and along the cup lower edges in boundaries between the cup lower edges and the base part, each lower edge portion having a lower edge side adjacent to a cup side edge;

side press parts each of which is located on a back side of the cup side lower part, has a non-stretchable characteristic, and presses a breast side area, wherein the side press part is superimposed on a back side of the lower edge side of the lower edge portion, a back side of the cup side edge, and the side press part is substantially supported in a supported portion by any one of a cup side edge, a cup side lower part, a base part side edge, and a a base part lower edge and is substantially not supported except in the supported portion.

2. The clothing article according to claim 1, wherein the lower edge portion is attached with a cup wire.

3. The clothing article according to claim 1, further comprising:

shoulder strap parts; and smoothing parts, each smoothing part connected to and extending from a cup side edge, a cup side upper part, and a base part side edge, to connect with a wing and to a shoulder strap part, the smoothing part having a stretchable characteristic, and functioning to smooth the cup side upper part with respect to the cup side edge.

* * * * *